US006202368B1

(12) United States Patent
Wallace, III

(10) Patent No.: US 6,202,368 B1
(45) Date of Patent: Mar. 20, 2001

(54) EARTH ANCHORING SYSTEM

(76) Inventor: Millard F. Wallace, III, 308 Emerald Cove Ct., Wilmington, NC (US) 28409

( * ) Notice: Subject to any disclaimer, the term of this patent is extended or adjusted under 35 U.S.C. 154(b) by 0 days.

(21) Appl. No.: 09/346,830

(22) Filed: Jul. 2, 1999

(51) Int. Cl.[7] ..... E02D 5/80
(52) U.S. Cl. ..... 52/157; 52/165; 248/156
(58) Field of Search ..... 52/153, 157, 155, 52/165, 296, 297, 298; 248/156

(56) References Cited

U.S. PATENT DOCUMENTS

| | | | | |
|---|---|---|---|---|
| D. 314,328 | | 2/1991 | Cobb . | |
| 1,791,368 | | 2/1931 | Mullett . | |
| 3,011,597 | | 12/1961 | Galloway et al. . | |
| 3,293,809 | | 12/1966 | Daline . | |
| 3,952,523 | | 4/1976 | Gale . | |
| 4,593,872 | | 6/1986 | Svenson . | |
| 4,644,713 | | 2/1987 | Lehman . | |
| 4,803,812 | | 2/1989 | Alexander . | |
| 4,850,564 | * | 7/1989 | Padin | 248/156 X |
| 4,863,137 | | 9/1989 | Cockman et al. . | |
| 4,923,165 | | 5/1990 | Cockman . | |
| 5,011,107 | | 4/1991 | Reece . | |
| 5,076,032 | | 12/1991 | Lehman . | |
| 5,090,165 | | 2/1992 | Kenny . | |
| 5,123,623 | | 6/1992 | McNamara . | |
| 5,135,192 | | 8/1992 | Winkler . | |
| 5,224,310 | * | 7/1993 | Edwards et al. | 52/165 |
| 5,240,353 | * | 8/1993 | Bower et al. | 52/157 X |
| 5,722,205 | | 3/1998 | Gannaway . | |
| 5,934,836 | * | 8/1999 | Rupiper et al. | 52/157 X |

* cited by examiner

*Primary Examiner*—Robert W. Gibson, Jr.
(74) *Attorney, Agent, or Firm*—Rhodes & Mason, PLLC

(57) ABSTRACT

A post system for use in installing fence posts, mailbox posts, and the like that includes a ground anchor having a tubular member with a circular cross-section of uniform diameter along its length, and a longitudinal axis, the tubular member having a lower end with a peripherally extending auger blade, and an upper end; and a post having first and second ends, and a bore extending into the post from one of the post ends, the tubular member upper end being insertable into the post bore. The lower end of the ground anchor is screwed into the ground, and a length of the tubular member approximately equal to the length of the bore is left exposed above ground level. The post is then telescoped onto the above-ground part of the tubular member by inserting the exposed part of the tubular member into the post bore. The ground anchor may be used alone as a post, and the post system, or ground anchor alone, may also be employed as a ground anchor for modular homes.

20 Claims, 2 Drawing Sheets

EARTH ANCHORING SYSTEM

BACKGROUND OF THE INVENTION (1) Field of the Invention

The present invention relates generally to a post structure, and in particular to a multi-part post system including a ground anchor for vertical insertion into the earth, and a post that is mounted onto an above-ground portion of the anchor. The invention also contemplates use of the ground anchor without the post.

(2) Description of the Prior Art

Posts such as fence posts, mailbox posts, and the like, are conventionally mounted vertically above the surface of the ground by inserting the lower end of the post into a prepared hole. After the post has been vertically aligned, e.g., by placing a spirit level along the side of the post, the area around the post is filled with dirt or a concrete mix. This procedure, while effective, is time consuming. In addition, the lower end of the post will rot over time due to exposure to moisture in the soil. Also, removal or replacement of the post, particularly if the lower end is set in concrete, can be difficult.

Alternative post mounting procedures use devices known as ground anchors, which are described in various prior art patents, including the following:

| U.S. Pat. No. | Inventor(s) |
|---|---|
| 3,011,597 | Galloway et al. |
| 3,952,523 | Gale |
| 4,593,872 | Svensson |
| 4,803,812 | Alexander, Sr. |
| 4,863,137 | Cockman |
| 4,923,165 | Cockman |
| 5,011,107 | Reece |

Ground anchors of the type used to mount posts are basically comprised of a rod or staff having a lower end that is inserted into the ground, and an upper end to which the lower end of a post is secured. While the lower end of the rod can be simply driven into the earth, many ground anchors include an auger blade around the lower end of the rod, so that the rod can be screwed into the earth to provide a more stable anchor.

These ground anchors, have some advantages over conventional post mounting, in particular, ease of post installation, and post removal or replacement. However, correct installation of post anchors is difficult, since the anchor must be installed vertically in order for the post to be vertical. While specialized, bulky devices are available in the prior art to facilitate vertical insertion of ground anchors, their cost to the average homeowner is prohibitive. Vertical insertion of prior art anchors either manually or with hand operated power tools has not been possible.

An additional problem with prior art ground anchors is due to the fact that the connection between the post and the ground anchor is only between the extreme lower end of the post and the extreme upper end of the anchor. For example, most prior art ground anchors include a horizontal plate at their upper end with spaced, upwardly projecting side plates. The lower post end is positioned on the horizontal plate and attached to the anchor with nails or screws that extend through the side plates and into the post. As a result, the post can be easily broken away from, or shifted in relation to, the ground anchor.

Prior art ground anchors, and post attached thereto, are often unstable. That is, the ground anchor, even if initially installed vertically, tends to shift or lean to a non-vertical alignment when even moderate lateral forces are placed against the post, due to the large moment arm of the post, and the small diameter of the rod which provides only a limited contact between the rod and adjacent earth. Avoidance of this problem has not been addressed in the past, however, due to the difficulty in inserting large diameter rods into the earth.

A system having the advantages of known ground anchors that also provided for ease of vertical anchor installation, improved attachment between the post and anchor, time and cost savings for the end consumer, prolonged fence life, and a high level of stability, would be of significant commercial value.

SUMMARY OF THE INVENTION

The present invention is directed to a post system that includes a ground anchor and a post mountable over an above-ground part of the ground anchor. The invention also contemplates a tool for use in vertically installing the ground anchor.

Generally, the post system providing the desired advantages over the prior art is comprised of a ground anchor having a lower end insertable into the earth, and an upper end adapted to project above ground level, and a post with an axially aligned internal bore adapted for insertion over the upper end of the anchor. The system also contemplates a tool for use in inserting the lower end of the ground anchor into the earth, and optional components to enhance the utility of the system.

More specifically, the ground anchor forming a part of the present system is comprised of a tube or tubular member having a lower segment for insertion into the earth and an upper segment that remains above-ground when the anchor is installed. At least the lower segment of the member is of a uniform cross-section along its length. A helical or auger blade extends outwardly from the outer periphery of the tubular member adjacent the lower end of the tubular member. The exact configuration of this blade is not critical to the invention. Normally, the blade will be spot welded to the tubular member. Preferably, both the blade and tubular member arc constructed of steel.

Two through holes, the use of which will be described in detail herein, extend transversely through the upper end of the tubular member. The longitudinal axis of each hole intersects the longitudinal axis of the tubular member. The longitudinal axes of the holes arc also perpendicular to each other, and are both horizontal when the tubular member is vertically aligned.

Unlike prior art ground anchors that use a small diameter rod, the present device is based upon a tubular member having a relatively large, uniform diameter, at least along the portion of the tubular member that is inserted into the earth. As a result of this larger diameter, a much greater surface area between the tubular member and the surrounding soil is achieved. Thus, due to the resultant much higher frictional forces that result, shifting of the anchor once it is in position is substantially reduced.

However, unlike insertion of prior art devices, it is not possible to simply push the soil outwardly as the device is inserted into the soil. Because of the large diameter of the tubular member, the volume of soil that would require displacement would require a force that would prohibit manual insertion. In other words, the tubular member could not be turned without a power tool. Moreover, if a power tool was used in an attempt to rotate the tubular member, the member might be twisted due to the resistance encountered.

Therefore, the tubular member is constructed so that most of the soil is moved through the interior of the tubular member as the tubular member is inserted into the soil. As a result, the only soil displaced during insertion of the tubular member is the soil displaced by the annular wall of the tubular member. This relatively small volume can be readily displaced manually by a single user. However, the advantages of the large diameter are achieved, since the frictional contact is between the exterior wall of the tube and the soil.

In order to ensure that the soil beneath the interior of the tube is moved into the tube interior during placement of the ground anchor, the lower edge of the tubular member is transverse to the longitudinal axis of the tubular member, as opposed to being beveled. In other words, the lower edge of the tubular member is circular, instead of oval. Therefore, during vertical insertion of the tube, the pressure against the soil is substantially equal around the periphery of the lower edge, so that the soil is not urged in a lateral direction. Also, the tube is of the same cross-sectional shape and dimension throughout its length, so that no part of the tube deflects soil away from the interior to the tube.

In order to achieve a reasonable level of stability, the tube should have a diameter of at least 1.25 inches. Diameters of above about 2.5 inches will not normally be employed due to cost, increased pressure during insertion, and post diameters, as will be discussed. Preferably, the outer diameter of the tube will be from about 1.25 to about 2.5 inches. The wall thickness of the tube will normally be from about 0.042 inch to about 0.16 inch. As a result, the inner diameter of the tube will normally be from about 0.75 inch to about 2.0 inches. As noted above, the diameter of the tube is equal along its entire length. Due to the larger diameter of the tube used, there is no need to include an enlarged sleeve or section at the upper end of the tube as required in prior art anchors.

The type of post used as a component of the present post system will vary depending on the end use and visual appearance desired. For example, the post may be of different materials, and of a circular or rectangular cross-section. For fences and mailbox posts to be installed by the homeowner, however, the post will preferably be a wooden or vinyl post of a square cross-section, e.g., a conventional 4×4 or 6×6 post.

In order to attach the post to the ground anchor, a central bore is drilled into the lower end of the post along the post's longitudinal axis. The bore diameter will be approximately equal to the outer tube diameter, so that a firm fit will result. In order to provide a secure attachment between the post and anchor, the bore will preferably be at least one-fourth of the length of the post, and preferably at least one-third of the post length.

The length of the anchor will depend to an extent upon the length of the post, with larger anchors being used with larger posts. When installed, from about 20% to about 70% of the tubular member will be left exposed above the ground for insertion into the post. Normally, the post bore will be from about 30 to 90% of the length of the post, and slightly longer that the length of the above-ground portion of the tubular member, so that a small head space remains after insertion of the tubular member into the bore.

From a commercial standpoint, it is desirable to have one anchor size that will be useable with different length posts. For example, a 6 foot post may have a bore length of about 32 inches, and will be used in combination with a ground anchor having a total length of 54 inches, with 28 inches of the tubular member being left exposed. A 4 foot post may have a bore length of about 32 inches can also be used with a ground anchor of the same dimensions.

The tool used to install the ground anchor is comprised of an elongated handle that includes a spirit level positioned so that the spirit level is centered when the handle is horizontal. The tool is designed for insertion through either of the through holes in the upper end of the ground anchor tubular member. Thus, the cross-section of the handle is approximately equal to the cross-sectional diameter of these tool insertion holes., so that a snug fit results. The tool handle may be a solid rod or a tube, with the spirit level attached adjacent one end of the handle.

Preferably, the handle is in the form of a tube having an opening or window near one end of the handle. A spirit level, e.g., an elongated tube of liquid, having a bubble that is centered when the liquid tube is horizontal, is mounted within the tubular handle beneath the opening. In this manner, the spirit level is protected from damage due to impact, while still being readily visible to the user.

The post system of the present invention may also include a ground plate that is slidably positioned over the ground anchor tubular member, and adapted to rest on the ground once the anchor is in position. The lower end of the post, after insertion over the anchor, then rests upon the ground plate, providing moisture protection, structural support, and elimination of weed growth immediately around the lower end of the post.

An additional component of the post system is a post spacing tool for use in spacing the ground anchors, and thereby the posts. The spacing tool is comprised of a pair of anchor connectors joined at a predetermined length from each other by an attachment line. Each anchor connector includes a hole or opening that has a diameter and cross-section approximately equal to the diameter and cross-section of a ground anchor, tubular member. For example, each connector can be in the form of a ring.

The attachment line, which can be rigid or flexible, is attached at each end to a connector, e.g., to an edge of the connector. The length of the attachment line is such that the distance between the center points of the openings in the connector rings is equal to the desired spacing between the post centers. For example, if the posts are to be spaced at eight foot distances from each other, the distance between the opening center points will be eight feet.

In order to install a post system, the lower end of the ground anchor is positioned on the surface of the ground, or into a shallow hole, where the post is to be installed. The tool handle is then inserted through the hole in the upper end of the tubular member that is closest to the lower end of the tubular member, i.e., the innermost handle insertion hole. The user then holds the tubular member in an approximately vertical position, and presses downward on the tool handle protruding from either side of the tubular member to rotate the tubular member in a clockwise direction, and cause the auger blade to screw the lower end of the tubular member into the earth.

As the tubular member is screwed into the earth, soil immediately beneath the tubular member is forced into the interior of the tubular member. As the tubular member is inserted into the soil, the user frequently checks the spirit level in the tool handle and urges the tubular member in the desired direction to ensure that the tubular member is being vertically inserted. After the tubular member has been partially inserted, the lower or innermost handle insertion hole will be close to ground level, making turning of the handle uncomfortable. At this stage, the tool handle may be moved to the other hole, i.e., the upper or outermost handle insertion hole. When the tubular member is almost completely inserted, the handle can be inserted through each of the holes in turn, and the spirit level checked to ensure that the tubular member is vertically aligned in both directions. Pressure in the appropriate direction can be inserted as appropriate to fine tune the alignment.

When the tubular member is inserted to the desired extent, approximately 10 to 72 inches of the length of the tubular member will project vertically above ground level. The post is then inserted or telescoped over the upper end of the tubular member by inserting the upper end of the tubular member into the post bore. As a result, the post is firmly attached to the ground anchor and is held in a stable, vertical position. If desired, the aforementioned ground plate can first be inserted onto the tubular member so that the plate rests on the ground around the tubular member. The post is then inserted onto the tubular member, so that the lower end of the post rests on the ground plate.

When a second tubular member is to be inserted into the ground, one connector of the post spacing tool is inserted over the tubular member of the first post system, and the second connector is inserted over the tubular member of the second ground anchor to be installed. The second ground anchor is then installed in the manner noted above while the attachment line is taut, thereby positioning the connectors and the tubular members at the desired spacing.

In some instances, such as when the post system may be subjected to high winds, the post system may also include a connector securing the post to the upper end of the tubular member. This connector exerts a clamping force between the post and anchor, urging the post downwardly and the anchor upwardly. As a result, the post and anchor are securely joined to each other.

In addition, when the connector is used with the above-described ground plate, substantially greater stability of the post system within the ground is achieved. That is, the post is pressed downwardly against the upper surface of the ground plate, while the auger blade of the anchor is urged upwardly, compressing the earth between the lower surface of the ground plate and the auger blade. Also, since the ground plate is urged against the ground surface, the post system is prevented from tilting.

Various ways to clamp the post and anchor together will be apparent to one skilled in the art. For example, the post and anchor may bolted together, e.g., the bolt and anchor may be joined by internally threading the upper end of the anchor tubular member, and drilling a bolt hole from the exterior upper end of the post into the post bore. Internal threading of the upper end of the tubular member can be achieved by forming threads in the inner wall of the tubular member, or by placing an internal threaded shim or an expandable member into the upper interior of the tubular member. A space is left between the upper end of the tubular member and the upper end of the bore, so that full insertion of the upper part of the tubular member into the bore is assured. A bolt comprised of a threaded rod portion with a head at its upper end is then inserted downwardly through the post bolt hole, which will have a diameter approximately equal to the diameter of the bold rod portion, and threaded into the upper end of the tubular member. A washer may also be placed on the top of the post.

As the bolt is tightened, the bolt head and washer press downwardly against the top of the post, while the anchor is urged upwardly. When the ground plate is combined with the post and anchor, the lower end of the post presses against the plate, while the auger blade compresses earth against the plate lower surface.

Alternatively, a threaded rod may project upwardly from the top of the anchor and through the top of the post. For example, a rod can be inserted into the interior of the tubular member, with the upper end of the rod being threaded. A nut can then be tightened onto the upper end of the threaded rod, with a washer if desired, to urge the post downwardly and the anchor upwardly. For some applications, e.g., when the system is being used as a ground anchor for modular homes, the tubular member can be entirely replaced by a rod, with the upper end of the rod being threaded.

Also, when the system is designed with the threaded rod, or a threaded upper end of the tubular member, projecting upward from the top of the anchor, the post bore can extend entirely through the post, without the need for a bolt hole of a different diameter. A plate or cap with a central opening for the threaded rod or thread top end of the tubular member, or a large washer, can then be placed on top of the post, with the rod extending upward through the plate opening. A nut can then be screwed onto the rod or threaded tubular member, and against the top of the plate.

While the present summary of the invention is primarily described in terms of an anchor that is used in combination with a post, the anchor can also be used without the post in certain circumstances. For example, a chain link or wire mesh fence can be directly attached to the above-ground portion of the anchor, which can serve as the fence post. In this instance, attachment brackets may be attached to the above-ground segment of the tubular member for attachment of the fence to the anchor.

The post system of the invention can also be used as a ground anchor for modular or mobile homes. The ground anchor can be used alone for this purpose by inserting ground anchors at spaced locations around the modular home, and attaching the frame of the modular home to the upper end of the anchor with cables. Preferably, however, the modular home anchor is comprised of a ground anchor with a ground plate similar to that described above. A short post or a cap of a similar configuration is fitted over the upper end of the ground anchor after the ground anchor is inserted into the ground, and the cap is secured to the upper end of the ground anchor. For example, a bolt as described above can be used to clamp the cap and ground anchor together, with the bottom edge of the cap being pressed against the ground plate. This pressure against the ground plate and the compression of the soil between the ground plate and the auger blade of the ground anchor provides a highly rigid structure that is difficult to withdraw from the earth. As a result, the modular home is securely anchored.

Accordingly, one aspect of the present invention is to provide a ground anchor for use in mounting a post, the post including opposed ends and a bore extending into the post from one of the ends, the anchor comprising a tubular member having a longitudinal axis and a uniform cross-section, the tubular member having a lower end adapted for insertion into the earth and an opposed upper end adapted to project above ground level; an auger blade extending outwardly from the tubular member adjacent the lower end; and first and second through holes having longitudinal axes perpendicular to, and intersecting, the longitudinal axis of the tubular member.

Another aspect of the present invention is to provide a post system comprised of the above ground anchor and a post having a first and second ends, the post including a bore extending into the post from one of the ends, the tubular member upper end being insertable into the post bore.

Still another aspect of the invention is to provide a post system comprised of the above-described anchor and post that also includes a connector joining the post to the upper end of the anchor.

These and other aspects of the present invention will become apparent to those skilled in the art after a reading of the following description of the preferred embodiment.

DETAILED DESCRIPTION OF THE INVENTION

Figure 1:
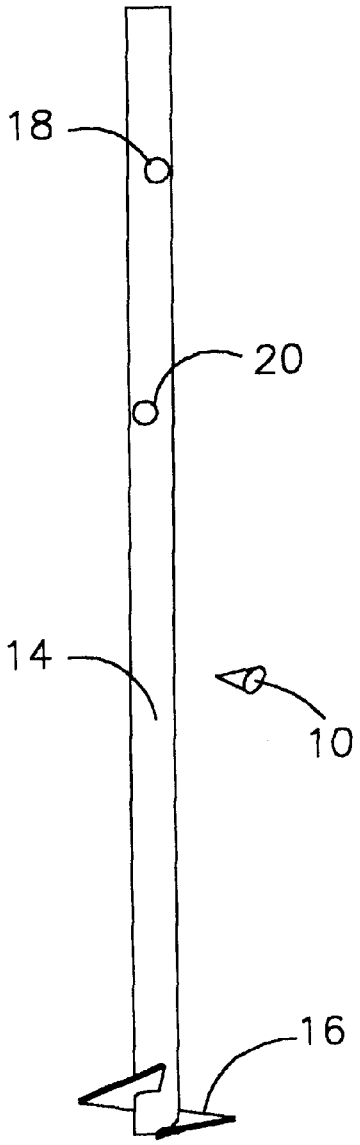
FIG. 1 is a side view of a ground anchor.
Figure 2:
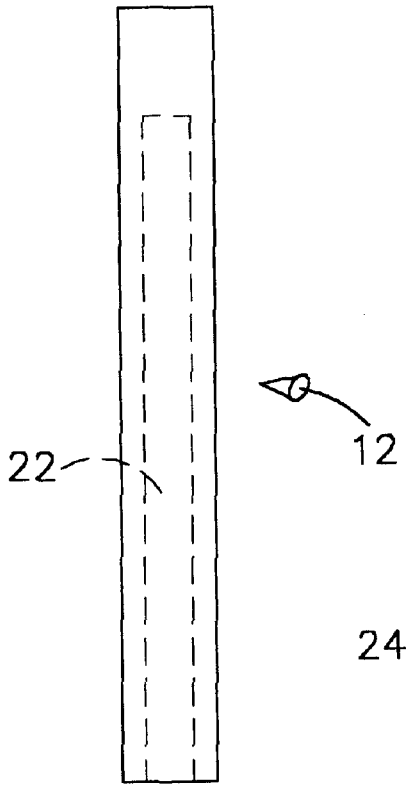
FIG. 2 is a sectional side view of a post mountable on the anchor of FIG. 1.
Figure 4:
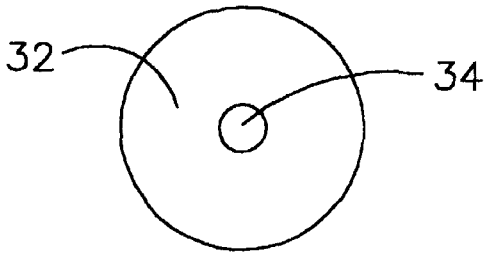
FIG. 4 is a top view of a ground plate.
Figure 5:
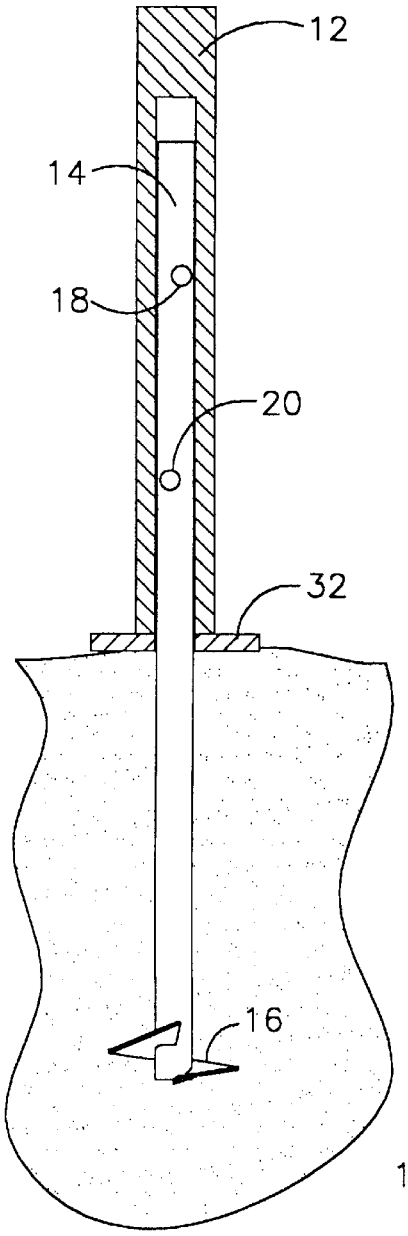
FIG. 5 is a side view of the assembled post system with a part of the ground anchor inserted into the ground, the post and plate being in sectional side view to illustrate the position of the ground anchor.
Figure 6:
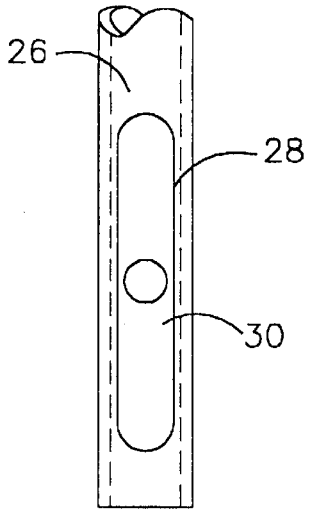
FIG. 6 is an enlarged top view of an end of the installation tool of FIG. 3, showing the spirit level in detail.

As best illustrated in FIGS. 1, 2 and 4, the post system of the present invention is comprised of a ground anchor, generally 10, and a post, generally 12. Anchor 10 is comprised of a tubular member 14 with an auger blade 16 projecting from about its lower end. Outer and inner handle insertion holes 18 and 20, respectively, extend through the upper end of tubular member 10, with the longitudinal axes of holes 18 and 20 extending through the longitudinal axis of tubular member 14. The longitudinal axes of holes 18 and 20 are in parallel planes and are transverse to each other.

Post 12 in the preferred embodiment is a wooden or vinyl post having a square cross-section, and an internal bore 22 extending from one end of post 12 along the longitudinal axis of post 12. In a preferred embodiment, post 12 has an overall length longer than the part of the tubular member above the ground, and bore 22 that varies in length. Tubular member 14, when designed for use with a post of these dimensions is a steel tube having a length of 54 inches, an outer diameter of between 1.25 and 2.5 inches, and a wall thickness of from about 0.042 to 0.160 inch. Through holes 18 and 20 have a cross-sectional diameter of less than tubular member 14, and are spaced from each other at a varying length.

Posts of different sizes may also be used. For example, post 12 may be 6 feet in length, with a bore of 32 inches. With a post of these dimensions, tubular member 14, will preferably have a length of 54 inches. When the ground anchor is inserted in either embodiment, a length of ground anchor approximately equal to the length of bore 22 will be left exposed above ground, so that the tubular member will be inserted into substantially the entire length of bore 22.

Figure 3:
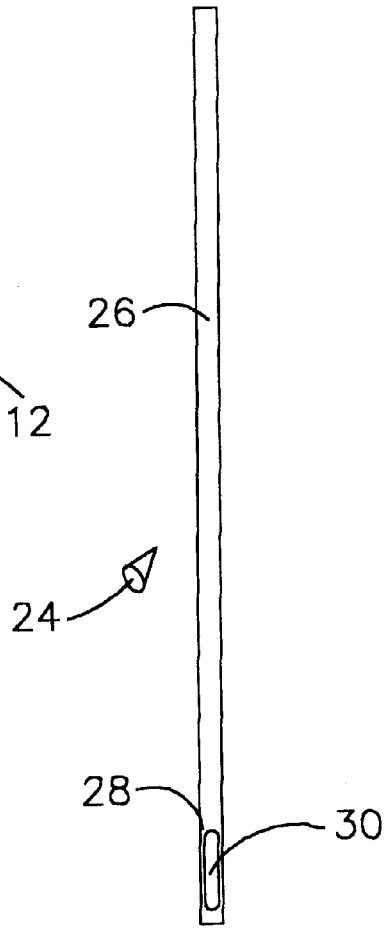
FIG. 3 is a top view of a ground anchor installation tool.

FIG. 3 illustrates installation tool 24 used to install ground anchor 10. Tool 24 is comprised of an elongated tubular handle 26 that has a cross-sectional configuration approximately equal to the cross-sectional configuration of tool insertion holes 18 and 20. Handle 26 includes an opening 28 near one end, and a spirit level 30 mounted within handle 26 beneath opening 28 so that level 30 is visible to the user during insertion of ground anchor 10.

FIG. 4 illustrates a ground plate 32, which is a doughnut-shaped or annular plate having a central opening 34 having approximately the dimensions of the cross-section of tubular member 14. It will be understood that the exact dimensions or plate 32 are not critical so long as the diameter of plate 32 is greater than the largest diameter of the cross-section of post 12. Preferably, plate 32 has a circular periphery. However, when post 14 has a square cross-section, a square plate having sides greater in length than the side dimensions of post 14 may be used.

Figure 7:
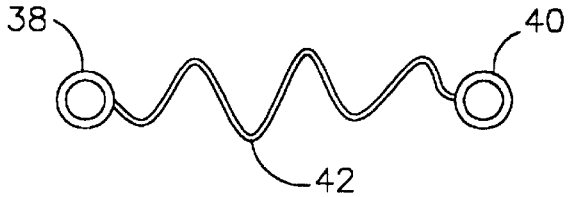
FIG. 7 is a top view of a post spacing tool.

FIG. 7 illustrates post spacing tool, generally 36, for use is spacing ground anchors 10, and thereby posts 14. Spacing tool 36 is comprised of a pair of anchor rings 38 and 40, preferably formed of metal and having an internal diameter greater than the outer diameter of tubular member 14, joined by attachment line 42.

Figure 8:
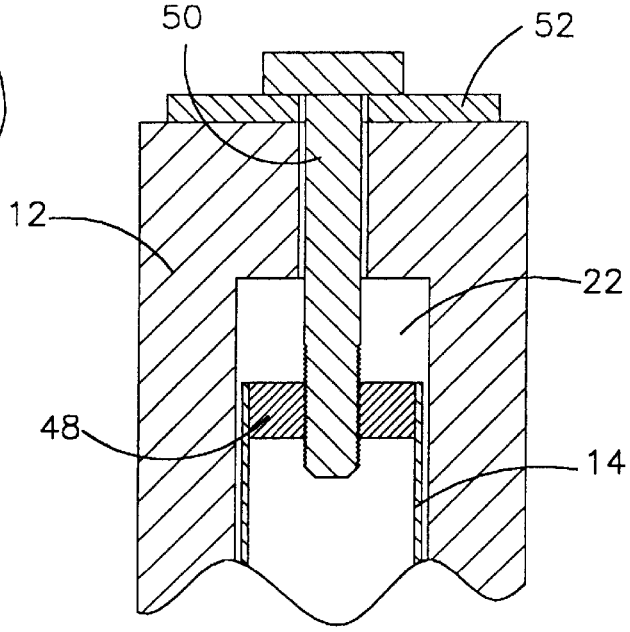
FIG. 8 is a sectional side view of a post and anchor with a connector securing the post to the upper end of the anchor.

FIG. 8 illustrates an embodiment of the post system in which the upper end of post 12 is secured to the upper end of tubular member 14. In this embodiment, a bolt hole is drilled between the top of post 12 and bore 22 along the longitudinal axis of post 12. A plate 48 is secured, e.g., by welding, at the top of member 14, with the plate including a threaded opening axially aligned with the bolt hole. A bolt 50 is inserted downwardly through the bolt hole and threaded into plate 48. A washer 52 may be placed between the head of bolt 50 and the top surface of post 12. A space 54 is left between the upper end of the tubular member and the upper end of the bore. Tightening of bolt 50 draws post 12 and anchor 10 together and, when plate 32 is used, presses plate 32 against the ground to provide enhanced stability.

To install the post system, tool handle 24 is inserted through hole 20 and the lower end of tubular member 14, i.e., the end of member 14 with auger blade 16, and the lower end of anchor 10 is placed on the ground. Anchor 10 is then rotated with handle 24 to screw anchor 10 into the ground. Handle 24 can also be moved to hole 18 during the latter stages of anchor insertion. During insertion, spirit level 30 is observed to ensure that anchor 10 is vertically aligned. When handle 26 is positioned horizontally, tubular member 14 will be vertically aligned in one dimension. Therefore, handle 26 is placed through holes 18 and 20 and the position of anchor 10 is adjusted as it is inserted, so that handle 26 is horizontal in both directions, thereby assuring vertical alignment of tubular member 14, and post 12 which is subsequently mounted thereon.

After tubular member is inserted to the extent desired, a length of tubular member 14 will remain above ground level. Post 12 is then mounted on the upper end of member 14 by inserting the upper end of member 14 into bore 22. If desired, plate 32 can be inserted onto member 14 before mounting of post 12.

Certain modifications and improvements will occur to those skilled in the art upon a reading of the foregoing description. It should be understood that all such modifications and improvements have been deleted herein for the sake of conciseness and readability but are properly within the scope of the follow claims.

What is claimed is:

1. A post system comprising:

a) a ground anchor including a longitudinal member having a longitudinal axis, said longitudinal member having a tubular lower segment with a uniform cross-section along its length, said lower segment having a longitudinal axis and a lower circular edge transverse to said longitudinal axis, and a peripherally extending auger blade, and an upper end; and b) a post having a upper and lower ends, said post including a bore extending at least partially into said post from said lower end, said tubular member upper end being insertable into said post bore.

2. The post system of claim 1, wherein said longitudinal member has first and second through holes, said through holes having longitudinal axes perpendicular to, and intersecting, the longitudinal axis of said longitudinal member.

3. The post system of claim 1, further including a connector securing said post to the upper end of said ground anchor.

4. The post system of claim 1, wherein the length of said post bore is from about 20 to about 70% of the length of said longitudinal member.

5. The post system of claim 1, wherein said tubular segment has a circular cross-section with an outside diameter of from about 1.25 inches to about 3.0 inches.

6. The post system of claim 1, wherein said longitudinal member is made of steel.

7. The post system of claim 1, further including a ground plate, said plate having a through hole with a cross-section approximately equal to the outer cross-section of said tubular segment.

8. The post system of claim 1, further including an insertion tool, said tool including an elongated handle attachable to the upper end of said longitudinal member, and a spirit level positioned to be centered when said handle is in a horizontal position.

9. The post system of claim 1, further including a post spacing tool, said tool including a pair of connectors, each of said connectors including a through hole having a cross-section with a cross-section greater that the cross-section of said tubular segment, said connectors being attached by an attachment line.

10. A ground anchor for use in mounting a post, said post including opposed ends and a bore extending into said post from one of said ends, said anchor comprising:

a) a tubular member having a longitudinal axis and a uniform cross-section, said tubular member having a lower end adapted for insertion into the earth, said lower end terminating in a circular edge transverse to said longitudinal axis and an opposed upper end adapted to project above ground level;

b) an auger blade extending outwardly from said tubular member adjacent said lower end; and c) first and second through holes having longitudinal axes perpendicular to, and intersecting, the longitudinal axis of said tubular member.

11. The ground anchor of claim 10, wherein said tubular member has a circular cross-section, and an outside diameter of from about 1.25 inches to about 3.0 inches.

12. The ground anchor of claim 10, wherein the length of said tubular member is from about 30 to about 108 inches.

13. The ground anchor of claim 10, wherein said tubular member is a steel tube having a wall thickness of from about 0.042 to about 0.160 inch.

14. A post system comprising:

a) a ground anchor including a tubular member having a longitudinal axis, said tubular member having a lower end adapted for insertion into the earth, said lower end having a uniform cross-section and a circular edge transverse to said longitudinal axis, and an opposed upper end adapted to project above ground level; an auger blade extending outwardly from said tubular member adjacent said lower end; and first and second through holes having longitudinal axes perpendicular to, and intersecting, the longitudinal axis of said tubular member; and b) a post having a upper and lower ends, said post including a bore extending into said post from said lower end, said tubular member upper end being insertable into said post bore.

15. The ground anchor of claim 14, wherein said tubular member has a circular cross-section, an outside diameter of from about 1.25 inches to about 3.0 inches, and a length of from about 30 to about 108 inches, and said post has a length of from about 10 to about 92 inches, said bore having a length of from about 24 to about 68 inches.

16. The post system of claim 14, further including a ground plate, said plate having a through hole with a diameter approximately equal to the outer diameter of said tubular member.

17. The post system of claim 14, further including an insertion tool, said tool including an elongated handle attachable to the upper end of said tubular member, and a spirit level positioned to be centered when said handle is in a horizontal position.

18. The post system of claim 14, further including a post spacing tool, said tool including a pair of rings, each of said rings having internal diameters greater than outer diameter of said tubular member, said rings being attached to each other by an attachment line.

19. The post system of claim 14, further including a connector securing said post to the upper end of said ground anchor.

20. The post system of claim 19, wherein said connector includes a threaded rod extending from the top of said tubular member through the top of said post.

* * * * *